US008292682B2

(12) United States Patent
Buche et al.

(10) Patent No.: US 8,292,682 B2
(45) Date of Patent: Oct. 23, 2012

(54) APPARATUS FOR AVOIDING TANGLING OF A SURF LEASH

(76) Inventors: James William Buche, San Diego, CA (US); John Karl Buche, La Jolla, CA (US)

( * ) Notice: Subject to any disclaimer, the term of this patent is extended or adjusted under 35 U.S.C. 154(b) by 667 days.

(21) Appl. No.: 12/263,385

(22) Filed: Oct. 31, 2008

(65) Prior Publication Data

US 2009/0117792 A1 May 7, 2009

Related U.S. Application Data

(60) Provisional application No. 60/984,705, filed on Nov. 1, 2007.

(51) Int. Cl.
*B63B 35/79* (2006.01)

(52) U.S. Cl. ..... 441/75

(58) Field of Classification Search ..... 441/75; 138/167, 156, 128, 118.1, 110
See application file for complete search history.

(56) References Cited

U.S. PATENT DOCUMENTS

| | | | | |
|---|---|---|---|---|
| 3,931,656 | A * | 1/1976 | Thomson | 441/75 |
| 4,610,634 | A | 9/1986 | Kimura | |
| 5,194,026 | A | 3/1993 | Corwin | |
| 5,901,756 | A * | 5/1999 | Goodrich | 138/167 |
| 6,500,039 | B1 | 12/2002 | Underwood | |
| 7,204,734 | B2 | 4/2007 | Kawasaki | |

* cited by examiner

*Primary Examiner* — Edwin Swinehart
(74) *Attorney, Agent, or Firm* — Buche & Associates, P.C.; John K Buche

(57) ABSTRACT

An improved surf leash with a tangle resistant cord, fabrication methods thereof, and an apparatus operationally configured to resist tangling of existing surf leashes.

4 Claims, 7 Drawing Sheets

APPARATUS FOR AVOIDING TANGLING OF A SURF LEASH

CROSS-REFERENCE TO RELATED PATENTS

Provisional Application Ser. No. 60/984,705, filed Nov. 1, 2007.

STATEMENT REGARDING FEDERALLY SPONSORED RESEARCH OR DEVELOPMENT

Not Applicable

BACKGROUND OF THE INVENTION

1. Field of Invention

The present application relates to the field of leashes for use with surfboards. This application claims the benefit of priority from the provisional patent application filed on Nov. 1, 2007, Ser. No. 60/984,705.

2. Background of the Invention

A surfboard leash is a cord that is used to attach a surfboard to the surfer. It is useful for preventing waves from taking a runaway surfboard to the beach, or from hitting other surfers. Leashes were introduced to surfing on or about the early 1970's, and they have evolved significantly since then, but the basic purposes for the leash are the same. Most modern leashes are comprised of a plastic cord, which is usually urethane, where one end has a band with a Velcro® styled strap (clinging pile and corresponding loop fastener mechanism) that is attached to a surfer's back foot, and where the other end has a Velcro® strap attached to the tail of a user's surfboard.

Despite the advances in surf leash technology, one major problem that persists with surf leashes is the tendency of the leash to tangle around the surfer's board and legs. The most common material for a surfboard leash is urethane. While the urethane is well suited for strength and balanced elasticity, the properties of this material, and other plastic cords, cause the leash to coil and tangle the user, often at undesirable times. On a day when waves are small, the problem may be just an annoyance. However, when the waves are large, or where the surf break has reef or sharp rocks, the condition of a tangled surfer can be extremely dangerous, or even deadly. A leash tangled around an ankle or a surfboard can delay take offs, limit needed mobility, or prevent a surfer from freedom to swim. A tangle in the leash can compromise a surfer's ability to gain distance from the surfboard, from other surfers, from large wave sets, and it increases the likelihood that a surfboard will strike and harm the surfer.

There have been some notable improvements that have tried to address the problem of leash tangling, however, they have not taken the approach of the embodiments of the present application or are inadequate for a variety of reasons. For example, U.S. Pat. No. 4,610,634 (1986) to Kimura taught swivel mechanisms at opposite ends of a leash cord, near the ankle cuff and near the cushion strip. This improvement is very helpful, but the cords still have a considerable length between the swivels that is susceptible to tangling. U.S. Pat. No. 5,194,026 (1993) to Corwin teaches a leash that attaches to a surfers hip, however, this does not eradicate the tangle factor adequately and many surfers, who are contraption resistant, do not want to deal with such an obstruction to movement, or to feel the presence of the equipment. U.S. Pat. No. 7,204,734 (2007) to Kawasaki, and related pending applications, teach a circular weight disposed at a mid-point of the leash cord, however, many surfers do not want to drag a weight, and there is some concern that a weighted object on a slinging leash could potentially be dangerous to surfers, other boards, or swimmers. U.S. Pat. No. 6,500,039 (2002) to Underwood teaches an apparatus where a modification to the surf cuff is used to address leash tangling. While each of the improvements are noteworthy, Applicants believe that they fail to adequately control the tangling factor of surf leashes. Moreover, Applicants believe that many of the prior art technologies are unlikely to be embraced and desired by surfers by reason of awkwardness of use, for reasons of inadequate safety, or simply because they distract the surfer's ability to experience the waves unencumbered by contraptions.

SUMMARY OF THE INVENTION

Accordingly, it is an object of the present application to provide a surfing leash that resists tangling.

It is yet another objective of the present application to provide a surf leash adaptation that may be constructed originally, or be used to retrofit existing surf leashes so they will resist tangling.

It is yet another objective of the present application to provide a surf leash that enhances the safety of the surfer.

It is yet another objective of the present application to provide a surf leash that does not obstruct existing equipment and that is not overly cumbersome or awkward to a surfer.

Other objectives of the invention will become apparent to those skilled in the art once the invention has been shown and described. These objectives are not to be construed as limitations of applicant's invention, but are merely aimed to suggest some of the many benefits that may be realized by the apparatus of the present application and with its many embodiments.

BRIEF DESCRIPTION OF THE DRAWING

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments that will be appreciated by those reasonably skilled in the relevant arts. Also, drawings are not necessarily made to scale but are representative.

DETAILED DESCRIPTION OF THE INVENTION

Figure 1:
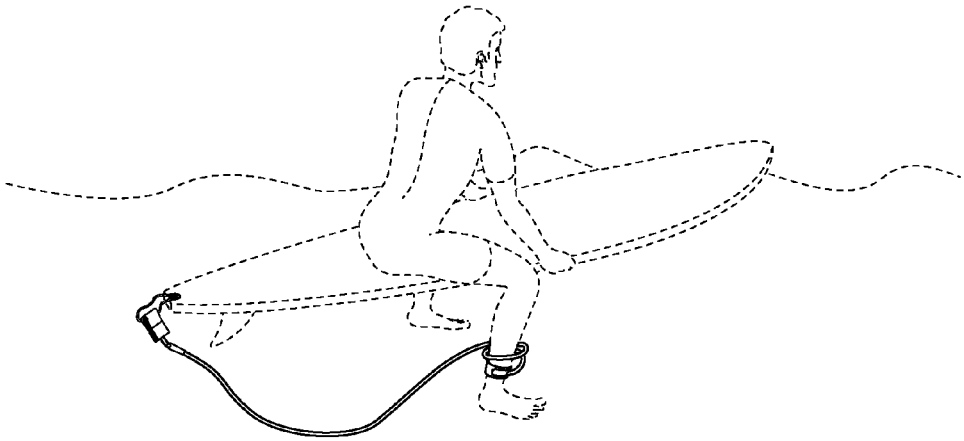
FIG. 1 (Prior Art)
FIG. 1 is a perspective drawing of a surfer, a surfboard, and a prior art leash as such leashes tend to tangle around the leg of the surfer.

FIG. 1 is a perspective drawing of a surfer, a surfboard, and a prior art leash as such leashes tend to tangle around the leg of the surfer. This is a primary problem addressed by the inventive embodiments of this application.

Figure 2:
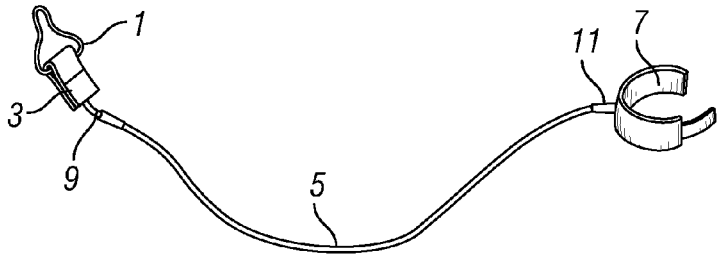
FIG. 2 (Prior Art)
FIG. 2 is a perspective drawing of a standard prior art surf leash and typical components.

FIG. 2 is a perspective drawing of a standard prior art surf leash and typical components thereof, which include but are not necessarily limited to, a cord 5; the cord 5 being adapted to connect ultimately on one end to a surfboard, and on a second end to a surfer. Such a cord 5 is usually made of urethane because this material has been found to have adequate strength and elastomeric properties, including a minimal tendency to cause a board to snap back at the user (such as is typical of surgical tubing). Various chemical compositions may be used to make up a surf leash cord 5, but the most common plastic is urethane. At one end of the cord (surfboard end), the cord 5 usually is connected to the board through a first connector 9, which usually meets a cushion strip 3, fastened to a string 1, which string 1 is usually adapted to fasten the leash to a surfboard through an anchor attachment in a surfboard. The first connector 1 is usually a hard (usually high density) plastic component that fastens securely to the cord 5, which first connector 1 may or may not feature a swivel mechanism (which is also aimed at reducing leash tangle). The first connector 1 of a typical leash will usually merge with a cushion strip 3, which serves a dual role of connecting a cord 5 to the surfboard string 1 and protecting the surfboard surface from abrasion by the cord 5. Many modern cushion strips 3 have a sandwiching Velcro® fastening mechanism that permits secure, but rapid separation of the surf leash from a surfboard. At the opposite end of a surf leash (the surfer end), the cord 5 has a second connector 11 which may or may not have a swivel mechanism, but that merges into a cuff 7 configured to wrap around the leg of a surfer. Cuffs 7 are commonly known and have a variety of quick release features, such as a Velcro® styled loop and fastener mechanism that allows a surfer to separate him or herself from the leash and surfboard, for instance, when transporting the surfboard, or when the surfboard or leash is caught on an underwater structure such as a reef and threatens to drown the surfer.

Figure 3:
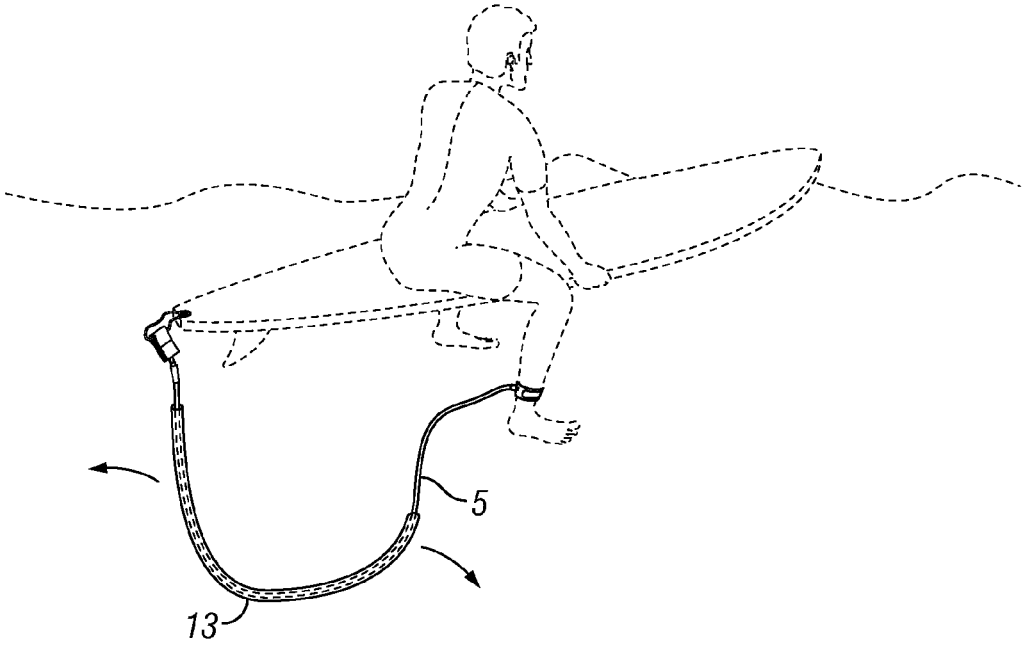
FIG. 3 is a perspective drawing of a preferable embodiment of this application where the tangle factor of a typical surf leash has been augmented by the use of a sheath with physical characteristics that cause a bias of the surf leash away from its natural coiling tendencies.

FIG. 3 is a perspective drawing of a preferable embodiment of this application where the tangle factor of a typical surf leash has been augmented and diminished by the use of a sheath 13 with physical characteristics that cause a bias of the cord 5 of the surf leash away from its natural coiling tendencies. The sheath 13 envelops a portion the cord 5 and does not allow the natural coiling tendencies.

Figure 4:
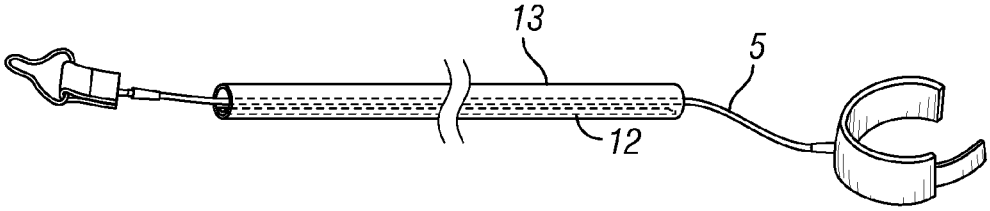
FIG. 4 is a perspective drawing of a preferable attachment of a sheath described in this application to a typical surf leash.

FIG. 4 is a closer view of an embodiment of the sheath 13 of the present application, including a view of resilient member 12 housed in the sheath 13. The resilient member 12 typically extends over a substantial portion of the length of the sheath 13 and is integrally housed in, on, or to the sheath 13. The resilient member 12 serves to stabilize and augment the natural tendency of urethane cord 5 to coil. The cord 5 cannot curl because it is physically restricted from doing so by the resilient member 12 of the sheath 13, which only bends in a restricted plane. The shape and flexibility of the resilient member 12 may be modified to accomplish a flexibility that will neither obstruct the normal trailing of the surf leash behind the surfer, nor remain so stiff to prevent bending of the leash. Also, as further discussed herein, a sheath 13 that envelops the cord 5 may feature a resilient member 12 with polygonal or rectangular shapes that restrict motion along the length of the sheath 13 in a plane so that tangling is prevented.

Figure 5:
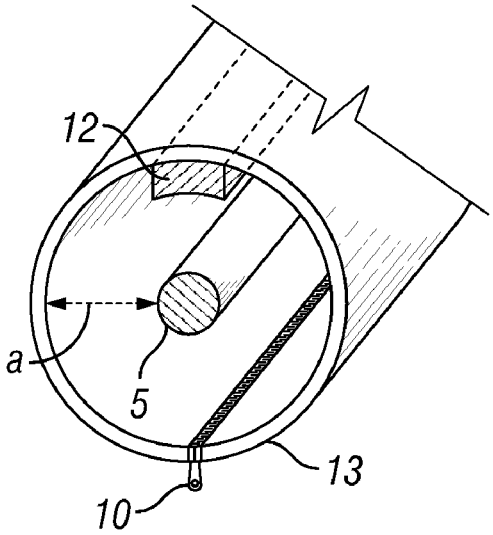
FIG. 5 is a cross sectional and perspective view of the sheath embodiment of the present application as it typically relates to components of a typical surf leash.

FIG. 5 is a cross sectional and perspective view of the sheath 13 embodiment of the present application as it typically relates to components of a typical surf leash. The sheath 13 is adapted to envelop the cord 5 along a substantial portion of the length of the cord 5. The sheath 13 may be secured around the leash cord 5 by use of a fastening means 10, such as may be appreciated by those skilled in the arts, and may include, but are not limited to adhesives, zippers, or Velcro® styled fasteners. The sheath 13 is adapted for aftermarket use on existing surf leashes as they are purchased off of the shelf in a typical surf store, so ease of attachment is of concern. FIG. 5 also shows the resilient member 12, in a rectangular shape and fixedly disposed along the sheath 13 of the embodiment. While the sheath 13 is adapted to envelop the cord 5, a distance "a" is used to show that some space is contemplated between the cord and the interior of the sheath 13, and the sheath may or may not move up and down along the length of the cord 5. This distance "a" between the cord 5 and sheath 13 interior may range and vary from about 0.1 to 30 millimeters, although it is possible that greater distances could operate.

Figure 6:
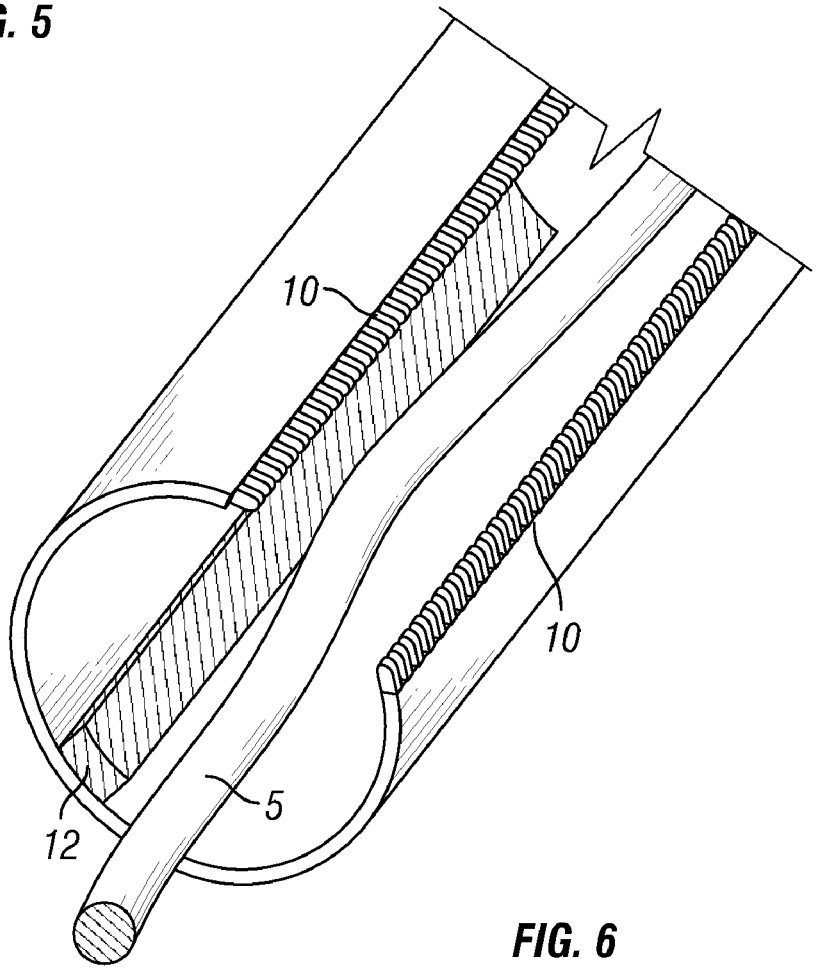
FIG. 6 is a closer cross sectional view of the sheath embodiment of the present application as it may be fastened around the cord of a typical surf leash, and also demonstrating a resilient member used to augment the natural tendencies of leashes to coil.

FIG. 6 is a closer cross sectional view of the sheath 13 embodiment of the present application as it may be fastened around the cord 5 of a typical surf leash, and also demonstrating a resilient member 12 used to augment the leash's natural tendencies to coil. While there is some play inside of the sheath 13 with the cord 5 that moves within the sheath 13, the resilient member 12 restricts coiling motion of cord 5. The resilient member 12 is of such a construction that its tendency to bend is restricted to a particular plane of motion, but without coil. The resilient member 12 lends its flexibility, yet limited range of motion to the sheath 13, which surrounds the cord 5. However, the cord 5 still benefits from the elastomeric and strength of a typical urethane cord 5. Thus, the leash of this embodiment enjoys all the benefits of a typical surf leash, without the likelihood of tangling. While most leashes are made of urethane, it is contemplated that the embodiment of this invention will work with a cord 5 of any chemical construction. The resilient member 12 is typically constructed of a semi-flexible plastic material, including but not limited to materials such as high density polyethylene, high density polypropylene, polyvinyl chloride, or other hard plastic, composite, metal, or any other partially flexible, but resilient material 12.

Figure 7:
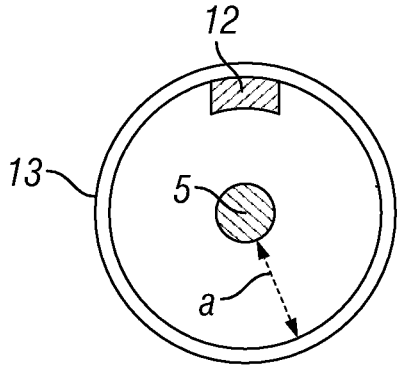
FIGS. 7, 7A, and 7B are cross sectional views of alternate embodiments and shapes of sheaths that may be used to accomplish the inventive purposes of this application.
Figure 7A:
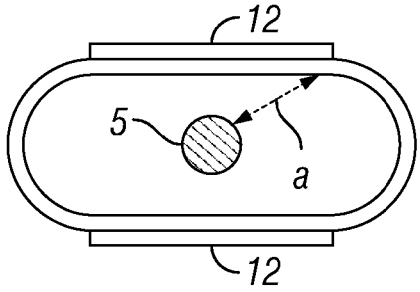
Figure 7B:
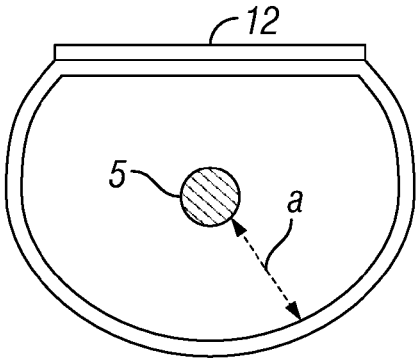

FIGS. 7, 7A, and 7B are cross sectional views of alternate embodiments and shapes of sheaths that may be used to accomplish the inventive purposes of this application. FIG. 7 is an embodiment of the sheath 13 where the sheath 13 is made to substantially define a circle around the cord 5, and where a resilient member 12 is fixedly and integrally connected to such sheath 13 along its interior. The sheath 13 material may be of a variety of constructions, but is typically formed from a durable cloth, preferably capable of withstanding the rigors of repeated exposures to salt and sea. Examples of such cloth may include but are not limited to ripstop nylon, polyester or other materials having such qualities. These materials will be appreciated by those skilled in the arts. It is generally the case that the sheath 13 material will have greater flexibility than the resilient member 12, although it is possible that the sheath 13 itself could also be used to impart a limited range of motion to the cord 5 of a surf leash. FIG. 7A represent another embodiment of the sheath 13 wherein a resilient member 12 may be fixedly connected along the exterior of the sheath 13, and where the sheath 13 may also define a principally ovular configuration around the cord 5 with a greater distance "a" occurring between the cord 5 and the interior of the sheath at the "sides." FIG. 7B represents an embodiment of the sheath 13 where the resilient member 12 comprises a broad portion of sheath 13 and is integrally connected to the sheath 13, including on the exterior, although the resilient member 12 may be woven or sandwiched inside the material of the sheath 13. A resilient member 12 is suitably of a range of width from about 2 millimeters to 40 millimeters in width, although other ranges are possible. A resilient member 12 typically extends over the entire length of sheath 13, although the resilient member may also be sectioned in the fashion of vertebrae of a spine, so long as the range of motion remains slightly restricted in a plane that prevents tangling.

Figure 8:
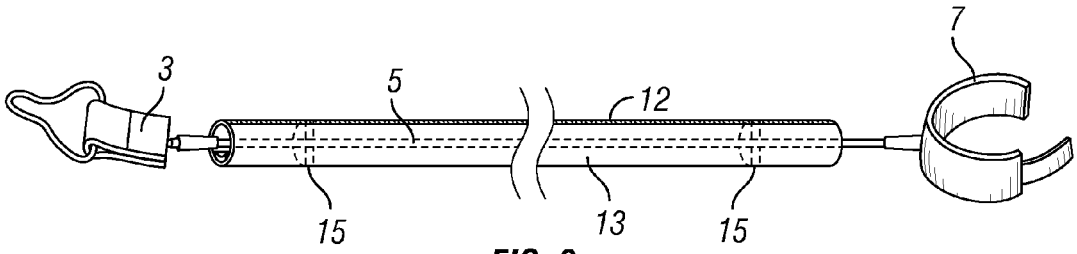
FIG. 8 is a depiction of a sheath embodiment of this application, with strategically placed supports to maintain sheath shape and positioning on a surf leash.

FIG. 8 depicts the sheath 13 embodiment of the present application, wherein the sheath 13 is further modified by supports 15 along the length of the sheath, which supports may be used to keep the sheath 13 from collapsing along its length, or also to secure the sheath to a desired place along the length of the cord 5. It is contemplated that the sheath 13 of the present application may extend along the entire length of the cord 5, or merely along a portion of the leash cord 5 adequate to prevent tangling. Most commercially available surf leashes range from 4 to 12 foot in length. The sheath 13 of the present application may be the same length of the cord 5 of the surf leash, but more typically is shorter that the cord 5 portion of the leash on which it is used. For example, on a 6 foot surf leash, which is a common short board size, the sheath 13 would typically be in the range of about 1.5 to 4 foot in length, and depending on the relative flexibility of the resilient member 12 employed.

Figure 9:
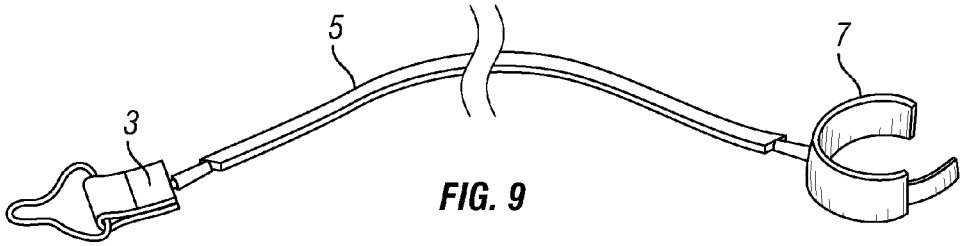
FIGS. 9, 10, 10A, and 11 relate to alternate cord shapes for a surf leash that are operationally configured to resist tangling.
Figure 10:
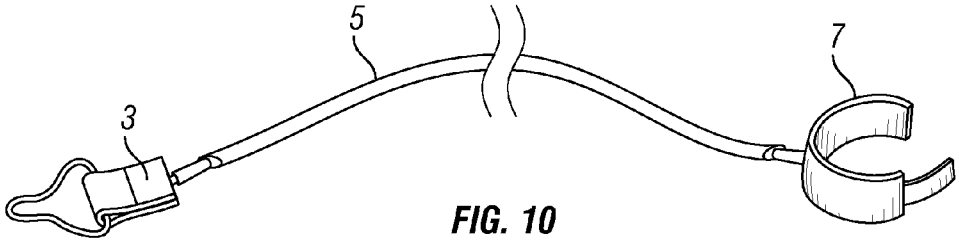
Figure 10A:
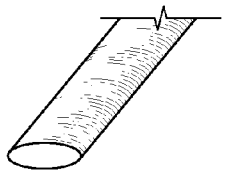
Figure 11:
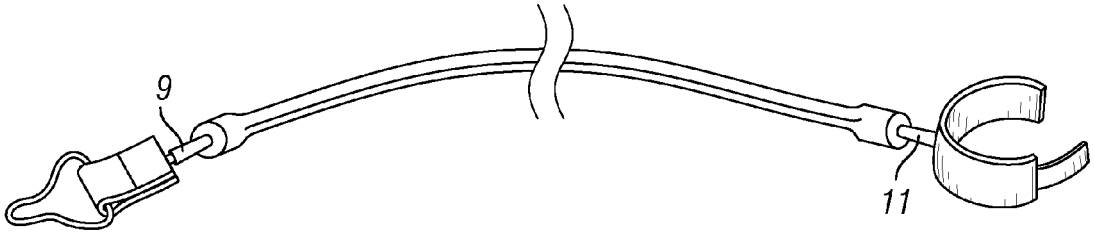

FIGS. 9, 10, 10A, and 11 depict alternate embodiments of the present application wherein the surf leash accomplishes tangling avoidance by virtue of a cord 5 with a shape fabricated to avoid tangling. FIG. 9 features a cord 5 that is rectangular in shape along the length. The rectangular shape is less prone to coiling because the rectangular shape causes motion and bending along a more restricted plane. In all other respects, the leash of FIG. 9 is similar to those known in the art. By the same token, FIG. 10 represents yet another embodiment of the invention where the cord 5 is of an ovular definition, and where the substantially "flatter" shape of the cord 5 resists tangling. FIG. 11 represents a hybrid version of the leash cord of the present application wherein the cord 5 varies in shape along its length. In FIG. 11, the flat section of the cord 5 is centrally located, but the cord 5 is principally circular near each end where it meets the first 9 and second 11 connectors.

Figure 12:
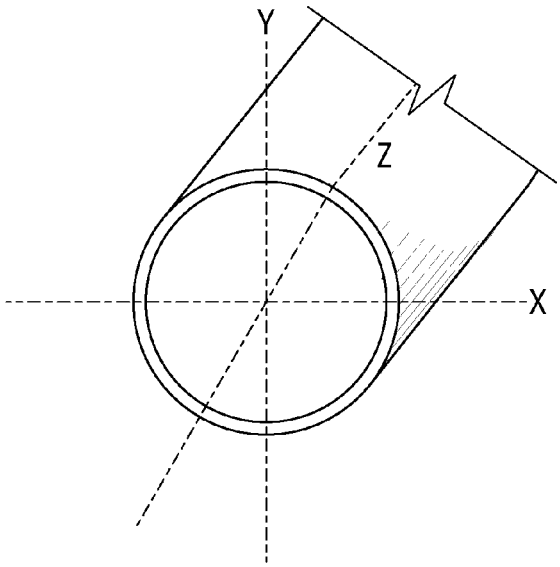
FIG. 12 is a cross section of a surf cords to illustrate the various dimension of a typical surf leash cord that may be modified, as seen in FIGS. 9, 10, 10A, and 11.

FIG. 12 is a cross section of a surf cord 5 designed to illustrate the various dimension of a typical surf leash cord that may be modified, as seen in FIGS. 9, 10, 10A, and 11, and where "x" and "y" represent cross sectional dimensions of a cord 5 and where "z" represents the longitudinal length of a cord 5. In FIGS. 9, 10, and 10A for example, the "x" distance would exceed the "y" distance to accomplish a more rectangular shape along the entire length "z" of the cord 5. In one non-limiting example, a typical "x" distance could be 2 centimeters, whereas a "y" would be 1.5 centimeters or less. Such as ratio of height to width avoids tangling, although various other ratios may also accomplish the non-tangling characteristics.

Figure 13:
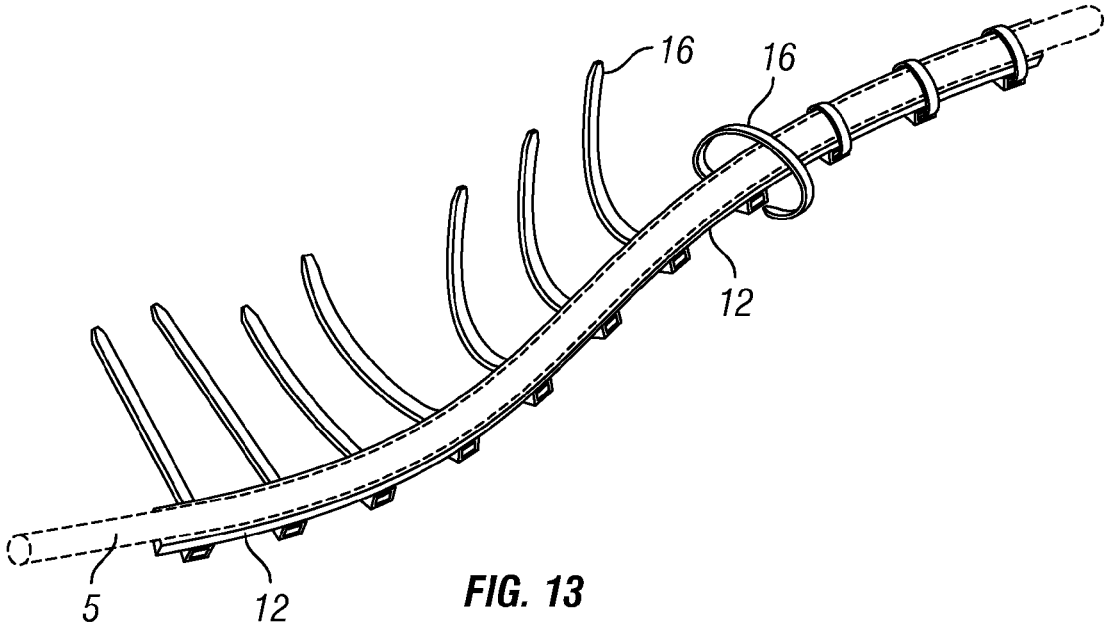
FIG. 13 is an alternate embodiment of this application featuring an adaptation for a surf leash featuring a plurality of ties that are used to envelop and modify the properties of a surf leash prone to tangling.

FIG. 13 is an alternate embodiment of this application featuring an adaptation for a surf leash featuring a plurality of ties 16 that are used to envelop and modify the properties of a surf leash cord 5 prone to tangling. In this embodiment, the sheath 13 is avoided and the tendency of the cord 5 to tangle is augmented instead by directly tying a resilient member 12 to the surf leash cord 5. Alternatively, this embodiment may be covered by a sheathing material in order to provide a uniform appearance and feel. Said sheathing material may consist of any type of ripstop nylon, polyester, urethane or other material with appropriately flexible characteristics.

Therefore, minimally disclosed are an apparatus for avoiding tangling of a surf leash comprising a sheath operationally configured to envelop the cord of a surf leash; said sheath securable around said cord by a fastening means; said sheath having at least one resilient member disposed along at least a portion of the length of said sheath. Further minimally disclosed is a tangle resistant surf leash comprising a cord; said cord having a first connector at one end with said first connector being fixed to a cushion strip for attachment to the string of a surfboard; a second connector at opposite end of said cord, said second connector secured to a cuff; wherein said cord is defined by the distance of an "x" component that is greater than a "y" component, or wherein said cord 5 defines a rectangular shape, or a substantially flattened shape, or an ovular shape.

It is to be noted, however, that the appended drawings illustrate only typical embodiments of this invention, are not to scale, and are therefore not to be considered limiting of its scope, for the invention may admit to other equally effective embodiments which are appreciated by those skilled in the arts.

The invention claimed is:

1. We claim an apparatus to avoid tangling of a surf leash comprising:

a. an elongated flexible sheath operationally configured to wrap around a cord of a surf leash;

b. an elongated resilient member disposed lengthwise along at least a portion of the length of said sheath;

c. a means for securing said resilient member and sheath around said cord of a surf leash;

d. wherein said sheath is always equal to or shorter than the length of the cord; and, e. wherein the resilient member is configured to only bend in a restricted plane.

2. The apparatus of claim 1 wherein said sheath is in the range of 1.5 to 4 foot in length.

3. We claim an apparatus to avoid tangling of a surf leash comprising:

an elongated sheath that is adapted to envelop a cord of a surf leash along a substantial portion of the length of the cord;

a resilient member coupled to the sheath lengthwise, wherein the resilient member extends over a substantial portion of the length of the sheath; and, wherein the resilient member is configured to only bend in a restricted plane.

4. The apparatus of claim 3 wherein the restricted plane is lengthwise on the resilient member.

* * * * *